US010448191B2

(12) United States Patent
Pang et al.

(10) Patent No.: US 10,448,191 B2
(45) Date of Patent: Oct. 15, 2019

(54) AUDIO SIGNAL PROCESSING APPARATUS AND METHOD

(71) Applicant: Huawei Technologies Co., Ltd., Shenzhen (CN)

(72) Inventors: Liyun Pang, Munich (DE); Peter Grosche, Munich (DE); Christof Faller, Uster (CH); Alexis Favrot, Uster (CH)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/001,411

(22) Filed: Jun. 6, 2018

(65) Prior Publication Data

US 2018/0324541 A1 Nov. 8, 2018

Related U.S. Application Data

(63) Continuation of application No. PCT/EP2015/078805, filed on Dec. 7, 2015.

(51) Int. Cl.
*H04S 1/00* (2006.01)
*H04S 7/00* (2006.01)

(52) U.S. Cl.
CPC ..... *H04S 7/303* (2013.01); *H04S 1/005* (2013.01); *H04S 2400/11* (2013.01); *H04S 2420/01* (2013.01)

(58) Field of Classification Search
CPC .. H04S 1/005; H04S 2400/11; H04S 2420/01; H04S 7/303

(Continued)

(56) References Cited

U.S. PATENT DOCUMENTS 5,440,639 A 8/1995 Suzuki et al.
7,167,567 B1 * 1/2007 Sibbald ..... H04S 5/00 381/1

(Continued)

FOREIGN PATENT DOCUMENTS

CN 104618843 A 5/2015
JP 2014506416 A 3/2014
WO 9931938 A1 6/1999

OTHER PUBLICATIONS

Algazi, V., et al, "The Use of Head-and-Torso Models for Improved Spatial Sound Synthesis," Audio Engineering Society Convention Paper, Oct. 5-8, 2002, 18 pages.

(Continued)

*Primary Examiner* — Paul Kim
*Assistant Examiner* — Friedrich Fahnert
(74) *Attorney, Agent, or Firm* — Conley Rose, P.C.

(57) ABSTRACT

An audio signal processing apparatus, comprising a memory configured to store a set of pairs of predefined left ear and right ear transfer functions, which are predefined for a plurality of reference positions relative to the listener, a processor configured to determine a pair of left ear and right ear transfer functions on the basis of the set of predefined pairs of predefined left ear and right ear transfer functions for the azimuth angle and the elevation angle of the virtual target position and an adjustment filter configured to filter the input audio signal on the basis of the determined pair of left ear and right ear transfer functions and an adjustment function configured to adjust a delay between the left ear transfer function and the right ear transfer function to obtain a left ear output audio signal and a right ear output audio signal.

20 Claims, 10 Drawing Sheets

(58) Field of Classification Search
USPC ..... 381/1, 17, 23.1, 26, 60, 303, 309
See application file for complete search history.

(56) References Cited

U.S. PATENT DOCUMENTS

| | | | | |
|---|---|---|---|---|
| 2001/0040968 | A1 | 11/2001 | Mukojima | |
| 2005/0117762 | A1* | 6/2005 | Sakurai | H04S 1/002 381/309 |
| 2009/0116657 | A1* | 5/2009 | Edwards | H04R 25/552 381/60 |
| 2012/0213375 | A1* | 8/2012 | Mahabub | H04S 5/00 381/17 |
| 2013/0336494 | A1 | 12/2013 | Bathgate et al. | |
| 2014/0198918 | A1* | 7/2014 | Li | H04S 7/30 381/26 |
| 2015/0124975 | A1* | 5/2015 | Pontoppidan | H04R 25/552 381/23.1 |
| 2016/0323678 | A1 | 11/2016 | Pontoppidan | |
| 2017/0126194 | A1* | 5/2017 | Jot | G06F 3/165 |

OTHER PUBLICATIONS

Duda, R., et al., "Modeling Head Related Transfer Functions," 1993 Conference Record of the Twenty-Seventh Asilomar Conference on Signals, Systems and Computers, Oct. 31-Nov. 3, 1993, 5 pages.

Duda, R., et al, "Range dependence of the response of a spherical head model," J. Acoust. Soc. Am., vol. 104, No. 5, Nov. 1998, pp. 3048-3058.

Gamper, H., "Head-related transfer function interpolation in azimuth, elevation, and distance," JASA Express Letters, Nov. 12, 2013, J. Acoust. Soc. Am., vol. 134, No. 6, Dec. 2013, pp. 547-553.

Gardner, B., et al, "HRTF Measurements of a KEMAR Dummy-head Microphone," MIT media lab perceptual computing-technical report, May 1994, 7 pages.

Carlile, S., "Virtual Auditory Space: Generation and Applications," Neuroscience Intelligence Unit, 1996, 13 pages.

Foreign Communication From a Counterpart Application, PCT Application No. PCT/EP2015/078805, International Search Report dated Jul. 8, 2016, 5 pages.

Foreign Communication From a Counterpart Application, PCT Application No. PCT/EP2015/078805, Written Opinion dated Jul. 8, 2016, 7 pages.

Foreign Communication From a Counterpart Application, Chinese Application No. 201580084740.0, Chinese Search Report dated Apr. 25, 2019, 2 pages.

Foreign Communication From a Counterpart Application, Chinese Application No. 201580084740.0, Chinese Office Action dated May 8, 2019, 6 pages.

Foreign Communication From a Counterpart Application, Korean Application No. 10-2018-7018740, Korean Office Action dated Jun. 20, 2019, 6 pages.

Foreign Communication From a Counterpart Application, Korean Application No. 10-2018-7018740, English Translation of Korean Office Action dated Jun. 20, 2019, 5 pages.

* cited by examiner

AUDIO SIGNAL PROCESSING APPARATUS AND METHOD

CROSS-REFERENCE TO RELATED APPLICATION

This application is a continuation of International Patent Application No. PCT/EP2015/078805 filed on Dec. 7, 2015, which is hereby incorporated by reference in its entirety.

TECHNICAL FIELD

Generally, the disclosure relates to the field of audio signal processing, and in particular, to an audio signal processing apparatus and method allowing for generating a binaural audio signal from a virtual target position.

BACKGROUND

The human ears can locate sounds in three dimensions in range (distance), in direction above and below (elevation), in front and in rear (azimuth), as well as to either (right or left) side. The properties of sound received by an ear from some point of space can be characterized by head-related transfer functions (HRTFs). Therefore, a pair of HRTFs for two ears can be used to synthesize a binaural sound that seems to come from a target position, i.e. a virtual target position.

Many applications of three dimensional (3D) audio using headphones, such as virtual reality, spatial teleconferencing, virtual surround, require high quality HRTF datasets, which contain transfer functions for all necessary directions. Some forms of HRTF-processing have also been included in computer software to simulate surround sound playback from loudspeakers. However, measuring HRTFs for all azimuth angles is a tedious task, which involves hardware and materials. Moreover, the memory required to store the database of measured HRTFs can be very large. Additionally, using personalized HRTFs can further improve the sound experience, but acquiring them complicates the process of the synthesis of 3D sound.

The idea of a fully parametric model for deriving HRTFs to synthesize binaural sound has been proposed in R. O. Duda. "Modeling head related transfer functions", 27th Asilomar Conference on Signals. Systems and Computers, 1993 and V. R. Algazi et al. "The use of head-and-torso models for improved spatial sound synthesis", Audio Engineering Society (AES) 113th Convention, October 2002. However, for realistic binaural sound rendering the obtained HRTFs are not accurate enough, since these models strongly deviate from the personalized HRTFs.

A lot of research has been conducted to develop a method to obtain HRTFs that would not strongly deviate from personalized (user specific) HRTFs. 3D HRTFs interpolation can be used to obtain estimated HRTFs at the desired source position from measured HRTFs, as demonstrated in H. Gamper, "Head-related transfer function interpolation in azimuth, elevation and distance", Journal of the Acoustical Society of America (JASA) Express Letters, 2013. This technique requires HRTFs measured at nearby positions, e.g. four measurements forming a tetrahedral enclosing the desired position. Additionally, it is hard to achieve a correct elevation perception with this technique.

Thus, there is a need for an improved audio signal processing apparatus and method allowing for generating a binaural audio signal from a virtual target position.

SUMMARY

It is an object of the disclosure to provide an improved audio signal processing apparatus and method allowing for generating a binaural audio signal from a virtual target position.

This object is achieved by the feature of independent claims. Further implementation forms are apparent from the dependent claims, the description and the figures.

According to a first aspect, the disclosure relates to an audio signal processing apparatus for processing an input audio signal to be transmitted to a listener in such a way that the listener perceives the input audio signal to come from a virtual target position defined by an azimuth angle and an elevation angle relative to the listener, the audio signal processing apparatus comprising a memory configured to store a set of pairs of predefined left ear and right ear transfer functions, which are predefined for a plurality of reference positions relative to the listener, wherein the plurality of reference positions lie in a two-dimensional plane, a determiner configured to determine a pair of left ear and right ear transfer functions on the basis of the set of pairs of predefined left ear and right ear transfer functions for the azimuth angle and the elevation angle of the virtual target position and an adjustment filter configured to filter the input audio signal on the basis of the determined pair of left ear and right car transfer functions and an adjustment function configured to adjust a delay between the left ear transfer function and the right ear transfer function of the determined pair of left ear and right ear transfer functions and a frequency dependence of the left ear transfer function and the right ear transfer function of the determined pair of left ear and right ear transfer functions as a function of the azimuth angle and/or the elevation angle of the virtual target position in order to obtain a left ear output audio signal and a right ear output audio signal.

Thus, an improved audio signal processing apparatus allowing for generating a binaural audio signal from a virtual target position is provided. In particular, the audio signal processing apparatus according to the first aspect allows extending a set of predefined transfer functions defined for virtual target positions in a two-dimensional plane, for instance in the horizontal plane (which for a given scenario are very often already available), relative to the listener, in a computationally efficient manner to the third dimension, i.e. to virtual target positions above or below this plane. This has, for instance, the beneficial effect that the memory required for storing the predefined transfer functions is significantly reduced.

The set of pairs of predefined left ear and right ear transfer functions can comprise pairs of predefined left ear and right ear head related transfer functions.

The set of pairs of predefined left ear and right ear transfer functions can comprise measured left ear and right ear transfer functions and/or modelled left ear and right ear transfer functions. Thus, the audio signal processing apparatus according to the first aspect can use a database of user-specific measured transfer functions for a more realistic sound perception or modelled transfer functions, if user-specific measured transfer functions are not available.

In a first possible implementation form of the audio signal processing apparatus according to the first aspect as such, the adjustment filter is configured to adjust the delay between the left ear transfer function and the right ear transfer function of the determined pair of left ear and right ear transfer functions as a function of the azimuth angle and/or the elevation angle of the virtual target position by compensating for sound travel time differences associated with the distance between the virtual target position and a left ear of the listener and the distance between the virtual target position and a right ear of the listener.

By introducing a delay as a function of the azimuth angle and/or the elevation angle of the virtual target position, sound travel time differences can be compensated resulting in a more realistic sound perception by the listener.

In a second possible implementation form of the audio signal processing apparatus according to the first aspect as such or the first implementation form thereof, the adjustment filter is configured to adjust the delay between the left ear transfer function and the right ear transfer function of the determined pair of left ear and right ear transfer functions as a function of the azimuth angle and/or the elevation angle of the virtual target position on the basis of the following equations:

$$\tau_L(\Theta) = \tau\left(\Theta + \frac{\pi}{2}\right), \text{ and}$$

$$\tau_R(\Theta) = \tau\left(\Theta - \frac{\pi}{2}\right),$$

wherein $\tau_L$ denotes a delay applied to the left ear transfer function, wherein $\tau_R$ denotes a delay applied to the right ear transfer function and wherein $\tau$ and $\Theta$ are defined on the basis of the following equations:

$$\tau(\Theta) = \frac{a}{c}\sin\Theta, \text{ and}$$

$$\Theta = \begin{cases} \arcsin(\sin\theta\cos\phi), \text{ if } |\theta| < \frac{\pi}{2} \\ \frac{\theta}{|\theta|}\pi - \arcsin(\sin\theta\cos\phi), \text{ if } |\theta| \geq \frac{\pi}{2} \end{cases}$$

wherein $\tau$ denotes a delay in seconds, c denotes the velocity of sound, a denotes a parameter associated with the head of a listener, $\theta$ denotes the azimuth angle of the virtual target position and $\phi$ denotes the elevation angle of the virtual target position.

Thus, a delay for compensating sound travel time differences as a function of the azimuth angle and/or the elevation angle of the virtual target position can be determined in a computationally efficient way.

In a third possible implementation form of the audio signal processing apparatus according to the first aspect as such or the first or second implementation form thereof, the adjustment filter is configured to adjust the frequency dependence of the left ear transfer function and the right ear transfer function of the determined pair of left ear and right ear transfer functions as a function of the azimuth angle and/or the elevation angle of the virtual target position on the basis of a plurality of infinite impulse response filters, wherein the plurality of infinite impulse response filters are configured to approximate at least a portion of the frequency dependence of a left ear transfer function and a right ear transfer function of a plurality of pairs of measured left ear and right ear transfer functions as a function of the azimuth angle and/or the elevation angle of the virtual target position.

By approximating measured transfer functions by infinite impulse response filters and considering only the main spectral features thereof, in particular those which are relevant for the perception of azimuth and/or elevation, the computational complexity can be reduced.

In a fourth possible implementation form of the audio signal processing apparatus according to the third implementation form of the first aspect, the frequency dependence of each infinite impulse response filter is defined by a plurality of predefined filter parameters and wherein the plurality of predefined filter parameters are selected such that the frequency dependence of each infinite impulse response filter approximates at least a portion, in particular prominent spectral features, such as a spectral maximum or a spectral minimum, of the frequency dependence of a left ear transfer function or a right ear transfer function of the plurality of pairs of measured left ear and right ear transfer functions as a function of the azimuth angle and/or the elevation angle of the virtual target position.

Defining each infinite impulse response filter by a finite set of filter parameters allows saving memory space, as only the filter parameters have to be saved in order to reconstruct the main spectral features of the measured transfer functions.

In a fifth possible implementation form of the audio signal processing apparatus according to the fourth implementation form of the first aspect, the plurality of infinite-impulse-response filters comprises a plurality of biquad filters, i.e. biquadratic filters. The plurality of biquad filters can be implemented as parallel filters or cascaded filters. The use of cascaded filters is preferred as it approximates the spectral features of the transfer functions better. The order of the plurality of biquad filters can be different.

In a sixth possible implementation form of the audio signal processing apparatus according to the fifth implementation form of the first aspect, the plurality of biquad filters comprises at least one shelving filter, wherein the at least one shelving filter is defined by a cut-off frequency parameter $f_0$ and a gain parameter $g_0$, and/or at least one peaking filter, wherein the at least one peaking filter is defined by a cut-off frequency parameter $f_0$, a gain parameter $g_0$ and a bandwidth parameter $\Delta_0$.

The frequency dependence of shelving and/or peaking filters provides good approximations to the frequency dependence of the measured transfer functions on the basis of 2 or 3 filter parameters.

In a seventh possible implementation form of the audio signal processing apparatus according to the sixth implementation form of the first aspect, for at least one infinite impulse response filter of the plurality of infinite response filters the plurality of predefined filter parameters are selected by determining a frequency and an azimuth angle and/or an elevation angle, at which a left ear transfer function or a right ear transfer function of the plurality of pairs of measured left ear and right ear transfer functions has a minimal or maximal magnitude, and by approximating the frequency dependence of the left ear transfer function or the right ear transfer function of the plurality of pairs of measured left ear and right ear transfer functions by the frequency dependence of the at least one infinite impulse response filter.

Thus, the predefined filter parameters can be determined in a computationally efficient way.

In an eighth possible implementation form of the audio signal processing apparatus according to the sixth or seventh implementation form of the first aspect, the filter parameters, namely the cut-off frequency parameter $f_0$, the gain parameter $g_0$ and the bandwidth parameter $\Delta_0$ are determined on the basis of the following equations:

$$f_0=\max(m_f,\min(M_f,a_f(\phi-\phi_p)^2+f_p)),$$

$$g_0=\max(m_g,\min(M_g,a_g(\phi-\phi_p)^2+g_p)),$$

$$\Delta_0=\max(m_\Delta,\min(M_\Delta,a_\Delta(\phi-\phi_p)^2+\Delta_p)).$$

wherein $M_{f,g,\Delta}$ and $m_{f,g,\Delta}$ denote maximal and minimal values of f, g, Δ, respectively, and wherein $a_{f,g,\Delta}$ denote coefficients controlling the speed of changing the corresponding filter design parameters.

In a ninth possible implementation form of the audio signal processing apparatus according to the first aspect as such or any one of the first to eighth implementation form thereof, the adjustment filter is configured to filter the input audio signal on the basis of the determined pair of left ear and right ear transfer functions and the adjustment function by convolving the adjustment function with the left ear transfer function and by convolving the result with the input audio signal in order to obtain the left ear output audio signal and/or by convolving the adjustment function with the right ear transfer function and by convolving the result with the input audio signal in order to obtain the right ear output audio signal.

In a tenth possible implementation form of the audio signal processing apparatus according to the first aspect as such or any one of the first to eighth implementation form thereof, the adjustment filter is configured to filter the input audio signal on the basis of the determined pair of left ear and right ear transfer functions and the adjustment function by convolving the left ear transfer function with the input audio signal and by convolving the result with the adjustment function in order to obtain the left ear output audio signal and/or by convolving the right ear transfer function with the input audio signal and by convolving the result with the adjustment function in order to obtain the right ear output audio signal.

In an eleventh possible implementation form of the audio signal processing apparatus according to the first aspect as such or any one of the first to tenth implementation form thereof, the audio signal processing apparatus further comprises a pair of transducers, in particular headphones or loudspeakers using crosstalk cancellation configured to output the left ear output audio signal and the right ear output audio signal.

In a twelfth possible implementation form of the audio signal processing apparatus according to the first aspect as such or any one of the first to eleventh implementation form thereof, the pairs of predefined left ear and right ear transfer functions are predefined for a plurality of reference positions relative to the listener, which lie in the horizontal plane relative to the listener. That is, the set of pairs of predefined left ear and right ear transfer functions can consist of pairs of predefined left ear and right ear transfer functions for a plurality of different azimuth angles and a fixed zero elevation angle.

In a thirteenth possible implementation form of the audio signal processing apparatus according to the first aspect as such or any one of the first to twelfth implementation form thereof, the determiner is configured to determine the pair of left ear and right ear transfer functions on the basis of the set of pairs of predefined left ear and right ear transfer functions for the azimuth angle and the elevation angle of the virtual target position by selecting a pair of left ear and right ear transfer functions from the set of pairs of predefined left ear and right ear transfer functions for the azimuth angle and the elevation angle of the virtual target position and/or by interpolating a pair of left ear and right ear transfer functions on the basis of the set of pairs of predefined left ear and right ear transfer functions for the azimuth angle and the elevation angle of the virtual target position.

According to a second aspect, the disclosure relates to an audio signal processing method for processing an input audio signal to be transmitted to a listener in such a way that the listener perceives the input audio signal to come from a virtual target position defined by an azimuth angle and an elevation angle relative to the listener, the audio signal processing method comprising determining a pair of left ear and right ear transfer functions on the basis of a set of predefined left ear and right ear transfer functions for the azimuth angle and the elevation angle of the virtual target position, wherein the pairs of predefined left ear and right ear transfer functions are predefined for a plurality of reference positions relative to the listener, wherein the plurality of reference positions lie in a two-dimensional plane, and filtering the input audio signal, e.g. by an adjustment filter, on the basis of the determined pair of left ear and right ear transfer functions and an adjustment function configured to adjust a delay between the left ear transfer function and the right ear transfer function of the determined pair of left ear and right ear transfer functions and a frequency dependence of the left ear transfer function and the right ear transfer function of the determined pair of left ear and right ear transfer functions as a function of the azimuth angle and/or the elevation angle of the virtual target position in order to obtain a left ear output audio signal and a right ear output audio signal.

In a first possible implementation form of the audio signal processing method according to the second aspect as such, the adjustment function is configured to adjust the delay between the left ear transfer function and the right ear transfer function of the determined pair of left ear and right ear transfer functions as a function of the azimuth angle and/or the elevation angle of the virtual target position by compensating for sound travel time differences associated with the distances between the virtual target position and a left ear of the listener and between the virtual target position and a right ear of the listener.

In a second possible implementation form of the audio signal processing method according to the second aspect as such or the first implementation form thereof, the adjustment function is configured to adjust the delay between the left ear transfer function and the right ear transfer function of the determined pair of left ear and right ear transfer functions as a function of the azimuth angle and/or the elevation angle of the virtual target position on the basis of the following equations:

$$\tau_L(\Theta) = \tau\left(\Theta + \frac{\pi}{2}\right), \text{ and}$$

$$\tau_R(\Theta) = \tau\left(\Theta - \frac{\pi}{2}\right),$$

wherein $\tau_L$ denotes a delay applied to the left ear transfer function, wherein $\tau_R$ denotes a delay applied to the right ear transfer function and wherein τ and Θ are defined on the basis of the following equations:

$$\tau(\Theta) = \frac{a}{c}\sin\Theta, \text{ and}$$

$$\Theta = \begin{cases} \arcsin(\sin\theta\cos\phi), \text{ if } |\theta| < \frac{\pi}{2} \\ \frac{\theta}{|\theta|}\pi - \arcsin(\sin\theta\cos\phi), \text{ if } |\theta| \geq \frac{\pi}{2} \end{cases}$$

wherein τ denotes a delay in seconds, c denotes the velocity of sound, a denotes a parameter associated with the head of a listener, θ denotes the azimuth angle of the virtual target position and ϕ denotes the elevation angle of the virtual target position.

In a third possible implementation form of the audio signal processing method according to the second aspect as such or the first or second implementation form thereof, the adjustment function is configured to adjust the frequency dependence of the left ear transfer function and the right ear transfer function of the determined pair of left ear and right ear transfer functions as a function of the azimuth angle and/or the elevation angle of the virtual target position on the basis of a plurality of infinite impulse response filters, wherein the plurality of infinite impulse response filters are configured to approximate at least a portion of the frequency dependence of a left ear transfer function and a right ear transfer function of a plurality of pairs of measured left ear and right ear transfer functions as a function of the azimuth angle and/or the elevation angle of the virtual target position.

In a fourth possible implementation form of the audio signal processing method according to the third implementation form of the second aspect, the frequency dependence of each infinite impulse response filter is defined by a plurality of predefined filter parameters, wherein the plurality of predefined filter parameters are selected such that the frequency dependence of each infinite impulse response filter approximates at least a portion, in particular prominent spectral features, such as a spectral maximum or a spectral minimum, of the frequency dependence of a left ear transfer function or a right ear transfer function of the plurality of pairs of measured left ear and right ear transfer functions as a function of the azimuth angle and/or the elevation angle of the virtual target position.

In a fifth possible implementation form of the audio signal processing method according to the fourth implementation form of the second aspect, the plurality of infinite-impulse-response filters comprises a plurality of biquad filters, i.e. biquadratic filters. The plurality of biquad filters can be implemented as parallel filters or cascaded filters. The use of cascaded filters is preferred as it approximates the spectral features of the transfer functions better. The order of the plurality of biquad filters can be different.

In a sixth possible implementation form of the audio signal processing method according to the fifth implementation form of the second aspect, the plurality of biquad filters comprises at least one shelving filter, wherein the at least one shelving filter is defined by a cut-off frequency parameter $f_0$ and a gain parameter $g_0$, and/or at least one peaking filter, wherein the at least one peaking filter is defined by a cut-off frequency parameter $f_0$, a gain parameter $g_0$ and a bandwidth parameter $\Delta_0$.

In a seventh possible implementation form of the audio signal processing method according to the sixth implementation form of the second aspect, for at least one infinite impulse response filter of the plurality of infinite response filters the plurality of predefined filter parameters are selected by determining a frequency and an azimuth angle and/or an elevation angle, at which a left ear transfer function or a right ear transfer function of the plurality of pairs of measured left ear and right ear transfer functions has a minimal or maximal magnitude, and by approximating the frequency dependence of the left ear transfer function or the right ear transfer function of the plurality of pairs of measured left ear and right ear transfer functions by the frequency dependence of the at least one infinite impulse response filter.

In an eighth possible implementation form of the audio signal processing method according to the sixth or seventh implementation form of the second aspect, the filter parameters, namely the cut-off frequency parameter $f_0$, the gain parameter $g_0$ and the bandwidth parameter $\Delta_0$ are determined on the basis of the following equations:

$$f_0=\max(m_f,\min(M_f,a_f(\phi-\phi_p)^2+f_p)),$$

$$g_0=\max(m_g,\min(M_g,a_g(\phi-\phi_p)^2+g_p)),$$

$$\Delta_0=\max(m_\Delta,\min(M_\Delta,a_\Delta(\phi-\phi_p)^2+\Delta_p)).$$

wherein $M_{f,g,\Delta}$ and $m_{f,g,\Delta}$ denote maximal and minimal values of f,g,Δ, respectively, and wherein $a_{f,g,\Delta}$ denote coefficients controlling the speed of changing the corresponding filter design parameters.

In a ninth possible implementation form of the audio signal processing method according to the second aspect as such or any one of the first to eighth implementation form thereof, the step of filtering the input audio signal on the basis of the determined pair of left ear and right ear transfer functions and the adjustment function comprises the steps of convolving the adjustment function with the left ear transfer function and convolving the result with the input audio signal in order to obtain the left ear output audio signal and/or the steps of convolving the adjustment function with the right ear transfer function and convolving the result with the input audio signal in order to obtain the right ear output audio signal.

In a tenth possible implementation form of the audio signal processing method according to the second aspect as such or any one of the first to eighth implementation form thereof, the step of filtering the input audio signal on the basis of the determined pair of left ear and right ear transfer functions and the adjustment function comprises the steps of convolving the left ear transfer function with the input audio signal and convolving the result with the adjustment function in order to obtain the left ear output audio signal and/or the steps of convolving the right ear transfer function with the input audio signal and convolving the result with the adjustment function in order to obtain the right ear output audio signal.

In an eleventh possible implementation form of the audio signal processing method according to the second aspect as such or any one of the first to tenth implementation form thereof, the audio signal processing method further comprises the step of outputting the left ear output audio signal and the right ear output audio signal by means of a pair of transducers, in particular headphones or loudspeakers using crosstalk cancellation.

In a twelfth possible implementation form of the audio signal processing method according to the second aspect as such or any one of the first to eleventh implementation form thereof, the pairs of predefined left ear and right ear transfer functions are predefined for a plurality of reference positions relative to the listener, which lie in the horizontal plane relative to the listener.

In a thirteenth possible implementation form of the audio signal processing method according to the second aspect as such or any one of the first to twelfth implementation form thereof, the step of determining the pair of left ear and right ear transfer functions on the basis of the set of pairs of predefined left ear and right ear transfer functions for the azimuth angle and the elevation angle of the virtual target position comprises the step of selecting a pair of left ear and right ear transfer functions from the set of pairs of predefined left ear and right ear transfer functions for the azimuth angle and the elevation angle of the virtual target position or the step of interpolating a pair of left ear and right ear transfer functions on the basis of the set of pairs of predefined left ear and right ear transfer functions for the azimuth angle and the elevation angle of the virtual target position.

The audio signal processing method according to the second aspect of the disclosure can be performed by the audio signal processing apparatus according to the first aspect of the disclosure.

According to a third aspect the disclosure relates to a computer program comprising program code for performing the audio signal processing method according to the second aspect of the disclosure or any of its implementation forms when executed on a computer.

According to a fourth aspect, the disclosure relates to an audio signal processing apparatus for processing an input audio signal, comprising a memory configured to store a set of pairs of predefined left ear and right ear transfer functions, wherein each pair of the set of pairs of the predefined left ear and right ear transfer functions is predefined for each reference position of a plurality of reference positions relative to a listener, wherein each of the reference positions lies in a two-dimensional plane; a processor coupled to the memory and configured to determine a pair of left ear and right ear transfer functions of the set of pairs of the predefined left ear and right ear transfer functions according to an azimuth angle and an elevation angle of a virtual target position relative to the listener; and an adjustment filter coupled to the memory and the processor and configured to filter the input audio signal on a basis of the determined pair of the left ear and right ear transfer functions and an adjustment function, wherein the adjustment function is configured to adjust a delay between a determined left ear transfer function and a determined right ear transfer function of the determined pair of the left ear and right ear transfer functions; and adjust a frequency dependence of the determined left ear transfer function and the determined right ear transfer function as a function of the azimuth angle or the elevation angle on the basis of a plurality of infinite impulse response filters in order to obtain a left ear output audio signal and a right ear output audio signal, wherein a frequency dependence of each infinite impulse response filter of the plurality of infinite impulse response filters is defined by a plurality of predefined filter parameters, wherein for an infinite impulse response filter, the predefined filter parameters are selected by determining a frequency and the azimuth angle or the elevation angle at which a measured left ear transfer function or a measured right ear transfer function of pairs of measured left ear and right ear transfer functions has a minimal or a maximal magnitude; and a transmitter coupled to the memory and the processor and configured to transmit the left ear output audio signal and the right ear output audio signal to the listener to enable the listener to perceive the input audio signal as arriving from the virtual target position.

The disclosure can be implemented in hardware and/or software.

BRIEF DESCRIPTION OF DRAWINGS

Further embodiments of the disclosure will be described with respect to the following figures.

In the various figures, identical reference signs will be used for identical or at least functionally equivalent features.

DETAILED DESCRIPTION

In the following description, reference is made to the accompanying drawings, which form part of the disclosure, and in which are shown, by way of illustration, specific aspects in which the present disclosure may be placed. It is understood that other aspects may be utilized and structural or logical changes may be made without departing from the scope of the present disclosure. The following detailed description, therefore, is not to be taken in a limiting sense, as the scope of the present disclosure is defined be the appended claims.

For instance, it is understood that a disclosure in connection with a described method may also hold true for a corresponding device or system configured to perform the method and vice versa. For example, if a specific method step is described, a corresponding device may include a unit to perform the described method step, even if such unit is not explicitly described or illustrated in the figures. Further, it is understood that the features of the various exemplary aspects described herein may be combined with each other, unless noted otherwise.

Figure 1:
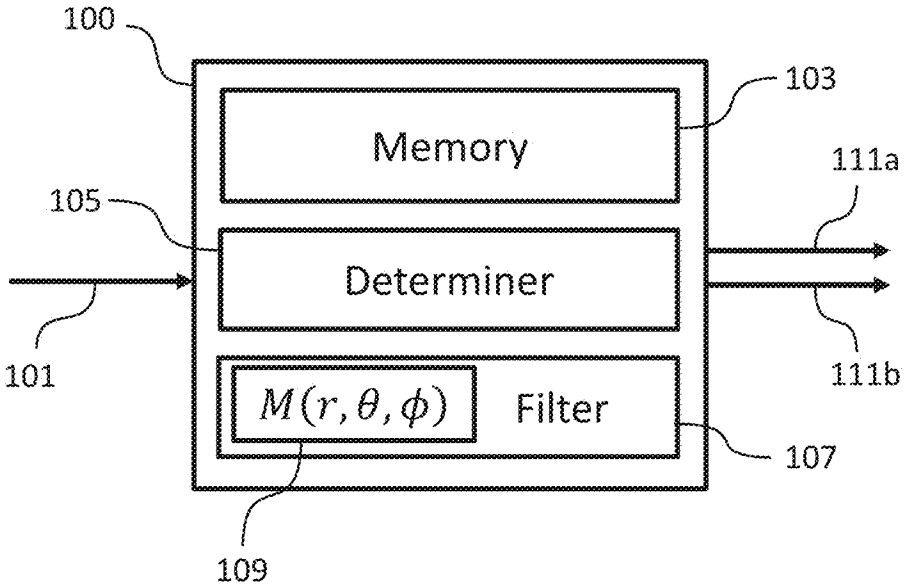
FIG. 1 shows a schematic diagram illustrating an audio signal processing apparatus according to an embodiment.

FIG. 1 shows a schematic diagram of an audio signal processing apparatus 100 for processing an input audio signal 101 to be transmitted to a listener in such a way that the listener perceives the input audio signal 101 to come from a virtual target position. In a spherical coordinate system the virtual target position (relative to the listener) is defined by a radial distance r, an azimuth angle $\theta$ and an elevation angle $\phi$.

The audio signal processing apparatus 100 comprises a memory 103 configured to store a set of pairs of predefined left ear and right ear transfer functions, which are predefined for a plurality of reference positions/directions, wherein the plurality of reference positions define a two-dimensional plane.

Moreover, the audio signal processing apparatus 100 comprises a determiner 105 configured to determine a pair of left ear and right ear transfer functions on the basis of the set of predefined left ear and right ear transfer functions for the azimuth angle and the elevation angle of the virtual target position. The determiner 105 is configured to determine the pair of left ear and right ear transfer functions for a position/direction associated with the virtual target position which lies in the two-dimensional plane defined by the plurality of reference positions. The determiner 105 is configured to determine the pair of left ear and right ear transfer functions by determining the pair of left ear and right ear transfer functions on the basis of the set of pairs of predefined left ear and right ear transfer functions for the projection of the virtual target position/direction onto the two-dimensional plane defined by the plurality of reference positions.

In an embodiment, the determiner 105 can be configured to determine the pair of left ear and right ear transfer functions on the basis of the set of pairs of predefined left ear and right ear transfer functions for the azimuth angle and the elevation angle of the virtual target position by selecting a pair of left ear and right ear transfer functions from the set of pairs of predefined left ear and right ear transfer functions for the azimuth angle and the elevation angle of the virtual target position.

In an embodiment, the determiner 105 can be configured to determine the pair of left ear and right ear transfer functions on the basis of the set of pairs of predefined left ear and right ear transfer functions for the azimuth angle and the elevation angle of the virtual target position by interpolating, for instance, by means of nearest neighbor interpolation, linear interpolation or the like, a pair of left ear and right ear transfer functions on the basis of the set of pairs of predefined left ear and right ear transfer functions for the azimuth angle and the elevation angle of the virtual target position. In an embodiment, the determiner 105 is configured to use a linear interpolation scheme, a nearest neighbor interpolation scheme or a similar interpolation scheme to determine a pair of left ear and right ear transfer functions on the basis of the set of pairs of predefined left ear and right ear transfer functions for the azimuth angle and the elevation angle of the virtual target position.

Moreover, the audio signal processing apparatus 100 comprises an adjustment filter 107 for extending the pair of left ear and right ear transfer functions, which has been determined by the determiner 105 for the projection of the virtual target position/direction onto the two-dimensional plane defined by the plurality of reference positions, to the "third dimension", i.e. to positions/directions above or below the two-dimensional plane defined by the plurality of reference positions. To this end, the adjustment filter 107 is configured to filter the input audio signal 101 on the basis of the determined pair of left ear and right ear transfer functions and a predefined adjustment function M(r, θ, ϕ) 109 configured to adjust a delay between the left ear transfer function and the right ear transfer function of the determined pair of left ear and right ear transfer functions and a frequency dependence of the left ear transfer function and the right ear transfer function of the determined pair of left car and right ear transfer functions as a function of the azimuth angle and/or the elevation angle of the virtual target position in order to obtain a left ear output audio signal 111*a* and a right ear output audio signal 111*b*.

In an exemplary embodiment, the set of pairs of predefined left ear and right ear transfer functions comprises four pairs of predefined left ear and right ear transfer functions in the horizontal plane. i.e. for an elevation angle ϕ=0°. The four pairs of predefined left ear and right ear transfer functions can be defined for the azimuth angles θ=0°, 90°, 180°, 270°, respectively. In case an exemplary virtual target position is associated with an azimuth angle θ=20° and an elevation angle ϕ=20°, the determiner 105 can determine the pair of left ear and right ear transfer functions for the azimuth angle θ=20° and the elevation angle ϕ=0° by means of a linear interpolation using the pairs of predefined left ear and right ear transfer functions at θ=0°, 90°. In an alternative embodiment, the determiner 105 can determine the pair of left ear and right ear transfer functions for the azimuth angle θ=20° and the elevation angle ϕ=0° by selecting the pair of predefined left ear and right ear transfer functions at θ=0° (which corresponds to a nearest neighbour interpolation). The extension of the determined pair of predefined left ear and right ear transfer functions at the azimuth angle θ=20° and the elevation angle ϕ=0° to the elevation angle ϕ=20° is performed by the adjustment filter 107.

The set of predefined left ear and right ear transfer functions can be, for example, a limited set of HRTFs. The set of pairs of predefined left ear and right ear transfer functions can be either personalized (measured for a specific user) or obtained from a generalized database (modelled).

As already mentioned above, in an embodiment, the set of pairs of predefined left ear and right car head related transfer functions can be defined for a plurality of azimuth angles and a fixed elevation angle. For instance, for a fixed elevation angle ϕ=0° the set of pairs of predefined left ear and right ear head related transfer functions can be defined as left ear HRTFs $h_L(r, \theta, 0)$ and right ear HRTFs $h_R(r, \theta, 0)$ parameterized by the azimuth angle θ.

As already mentioned above, in an embodiment, the set of pairs of predefined left ear and right ear head related transfer functions can be defined for a fixed azimuth angle and a plurality of elevation angles. For instance, for a fixed azimuth angle θ=0° the set of pairs of predefined left ear and right ear head related transfer functions can be defined as left ear HRTFs $h_L(r, \theta, \theta)$ and right ear HRTFs $h_R(r, 0, \phi)$ parameterized by the elevation angle ϕ.

Figure 2:
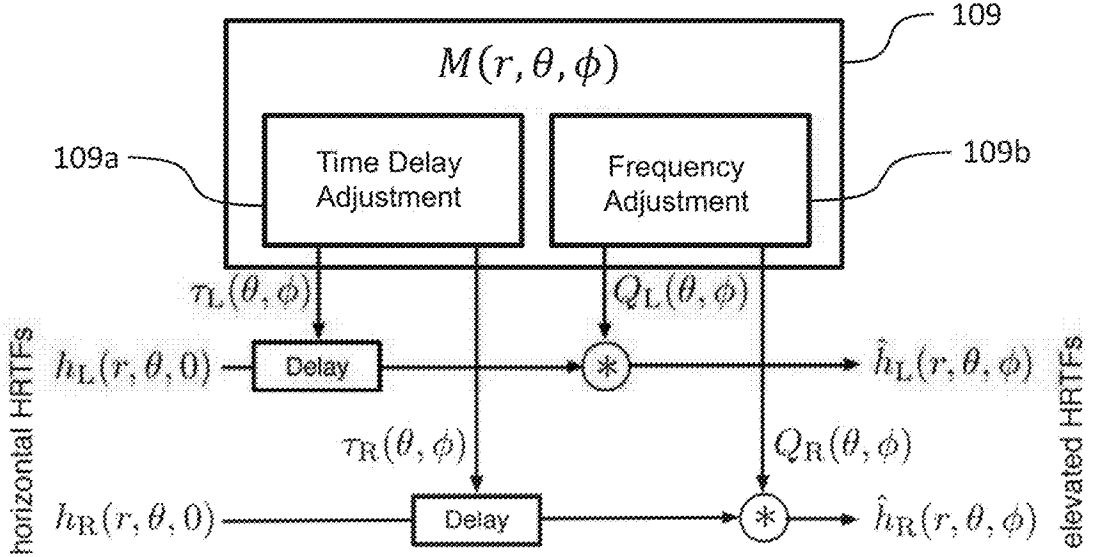
FIG. 2 shows a schematic diagram illustrating—an adjustment filter of an audio signal processing apparatus according to an embodiment.

FIG. 2 shows a schematic diagram illustrating an adjustment function M(r, θ, ϕ) 109 as used in an adjustment filter of an audio signal processing apparatus according to an embodiment, for instance the adjustment filter 107 of the audio signal processing apparatus 100 shown in FIG. 1. In the exemplary embodiment shown in FIG. 2 the set of pairs of predefined left ear and right ear head related transfer functions are horizontal transfer functions $h_L(r, \theta, 0)$ and $h_R(r, \theta, 0)$. i.e. transfer functions defined for reference positions/directions in the horizontal plane relative to the listener.

The adjustment function M(r, θ, ϕ) 109 shown in FIG. 2 comprises a delay block 109*a* for applying a delay to the horizontal transfer functions $h_L(r, \theta, 0)$ and $h_R(r, \theta, 0)$ and a frequency adjustment block 109*b* for applying a frequency adjustment to the horizontal transfer functions $h_L(r, \theta, 0)$ and $h_R(r, \theta, 0)$.

In an embodiment, the adjustment filter 107 is configured to adjust the delay 109*a* between the left car transfer function and the right ear transfer function of the determined pair of left ear and right ear transfer functions as a function of the azimuth angle and/or the elevation angle of the virtual target position on the basis of the adjustment function M(r, θ, ϕ) 109 by compensating for sound travel time differences associated with the distances between the virtual target position and a left ear of the listener and between the virtual target position and a right ear of the listener.

In an embodiment, the adjustment function 109 is configured to determine an additional time delay due to the elevation angle ϕ for the set of predefined transfer functions $h_L(r, \theta, 0)$ and $h_R(r, \theta, 0)$ on the basis of a new angle of incidence Θ derived in the constant elevation plane.

In an embodiment, the adjustment filter 107 is configured to adjust by means of the adjustment function 109 the delay 109*a* between the left ear transfer function and the right ear transfer function of the determined pair of left ear and right ear transfer functions as a function of the azimuth angle and/or the elevation angle of the virtual target position on the basis of the following equations:

$$\tau_L(\Theta) = \tau\left(\Theta + \frac{\pi}{2}\right), \text{ and}$$

$$\tau_R(\Theta) = \tau\left(\Theta - \frac{\pi}{2}\right),$$

wherein $\tau_L$ denotes a delay applied to the left ear transfer function, wherein $\tau_R$ denotes a delay applied to the right ear transfer function and wherein τ and Θ are defined on the basis of the following equations:

$$\tau(\Theta) = \frac{a}{c}\sin\Theta, \text{ and}$$

$$\Theta = \begin{cases} \arcsin(\sin\theta\cos\phi), \text{ if } |\theta| < \frac{\pi}{2} \\ \frac{\theta}{|\theta|}\pi - \arcsin(\sin\theta\cos\phi), \text{ if } |\theta| \geq \frac{\pi}{2} \end{cases}$$

wherein τ denotes a delay in seconds, c denotes the velocity of sound (i.e. c=340 meters per second (m/sec)), a denotes a parameter associated with the head of a listener (e.g. a=0.087 meters (m)), θ denotes the azimuth angle of the virtual target position and ϕ denotes the elevation angle of the virtual target position. The above equations for determining the new angle of incidence Θ are based on a projection of the azimuth angle θ of the virtual target position in the horizontal plane into the constant elevation plane.

The frequency adjustment block 109*b* of the adjustment function M(r, θ, ϕ) 109 shown in FIG. 2 is configured to apply a frequency adjustment to the horizontal transfer functions $h_L(r, \theta, 0)$ and $h_R(r, \theta, 0)$, in order to extend the "two-dimensional" set of pairs of predefined horizontal transfer functions by adding the relevant perceptual information related to elevation, i.e. the third dimension.

In an embodiment, the frequency adjustment block 109*b* of the adjustment function M(r, θ, ϕ) 109 shown in FIG. 2 can be based on a spectral analysis of a complete database of transfer functions, which covers all desired positions/directions. This allows, for example, to elevate or adjust the horizontal HRTFs, $h_L(r, \theta, 0)$ and $h_R(r, \theta, 0)$, which are defined by the azimuth angle θ in the horizontal plane, to an elevation angle ϕ above or below the horizontal plane.

Figure 3:
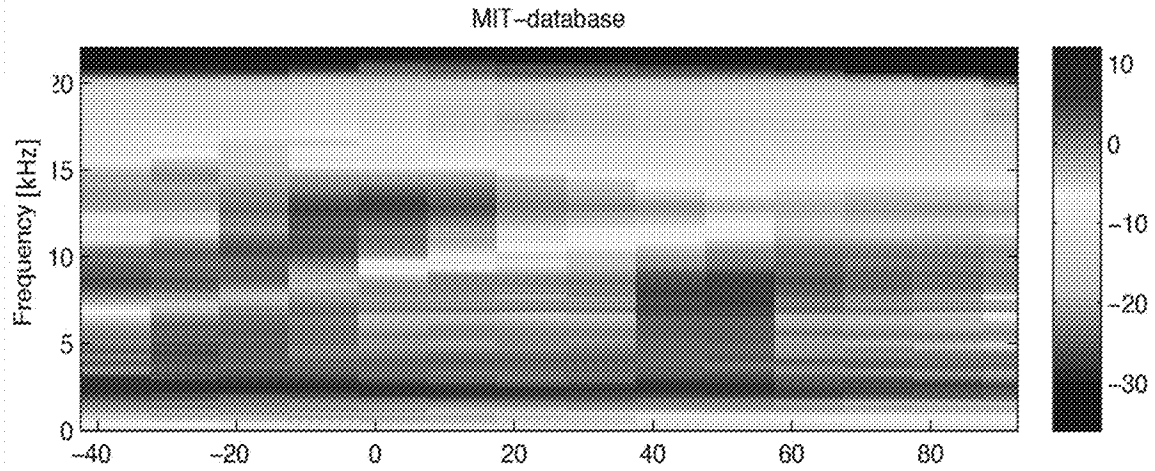
FIG. 3 shows a diagram illustrating an exemplary frequency magnitude analysis of a database of head related transfer functions as a function of the elevation angle for a fixed azimuth angle.

FIG. 3 shows an exemplary frequency magnitude analysis of a database of head related transfer functions as a function of the elevation angle, namely the measured Massachusetts Institute of Technology (MIT) HRTF database using the KEMAR dummy head. The frequency magnitude responses are shown in FIG. 3 for the left HRTFs $h_L$ as a function of the elevation angle ϕ for the azimuth angle θ=0° of the virtual target position. By repeating such spectral analysis for a plurality of azimuth angles of interest, a complete set of transfer functions can be obtained to extend any set of horizontal transfer functions defined only by the azimuth angle, to elevated ones at desired elevation angles.

In an embodiment, the transfer functions derived in the manner described above are replaced by equalizing, i.e. adjusting the frequency dependence, of a set of predefined left ear and right ear transfer functions, which preferably takes into account only the main spectral features relevant to the perception of elevation or azimuth angles. By doing so, the required data to generate elevated transfer functions is significantly reduced. The elevation or azimuth angles can be then rendered as a spectral effect. i.e. applying an equalization or adjustment function, and can be used on any transfer functions.

In an embodiment, the adjustment filter 107 of the audio signal processing apparatus 100 is configured to adjust the frequency dependence of the left ear transfer function and the right ear transfer function of the determined pair of left ear and right ear transfer functions as a function of the azimuth angle θ and/or the elevation angle ϕ of the virtual target position on the basis of a plurality of infinite impulse response filters, wherein the plurality of infinite impulse response filters are configured to approximate spectrally prominent features, such as a maximum or a minimum, of the frequency dependence of a left ear transfer function and a right car transfer function of a plurality of pairs of measured left ear and right ear transfer functions as a function of the azimuth angle and/or the elevation angle of the virtual target position.

In an embodiment, the frequency dependence of each infinite impulse response filter is defined by a plurality of predefined filter parameters, wherein the plurality of predefined filter parameters are selected such that the frequency dependence of each infinite impulse response filter approximates at least a portion of the frequency dependence of a left ear transfer function or a right ear transfer function of the plurality of pairs of measured left ear and right ear transfer functions as a function of the azimuth angle and/or the elevation angle of the virtual target position.

Figure 4:
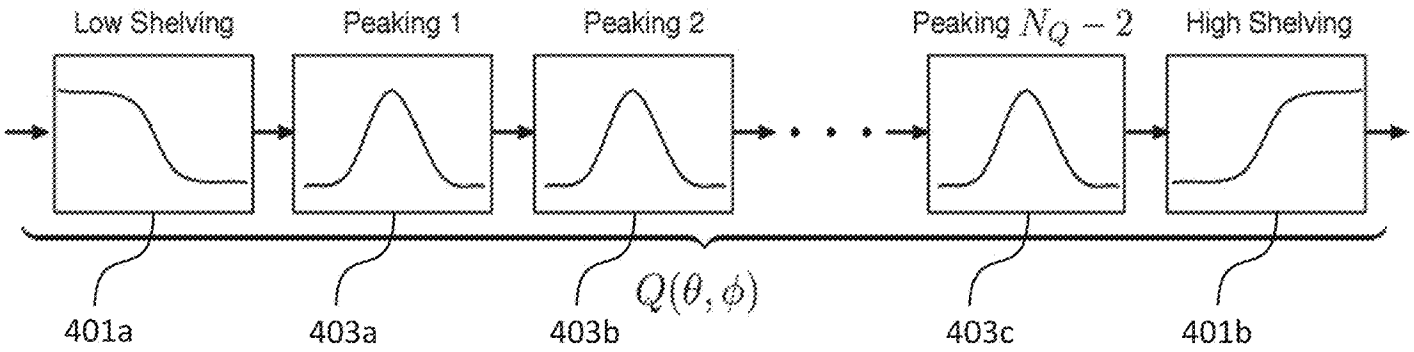
FIG. 4 shows a schematic diagram illustrating a plurality of biquad filters, including shelving filters and peaking filters, which can be implemented in an adjustment filter of an audio signal processing apparatus according to an embodiment.

In an embodiment, the plurality of infinite-impulse-response filters comprises a plurality of biquad filters. The plurality of biquad filters can be implemented as parallel filters or cascaded filters. The use of cascaded filters is preferred as it approximates the spectral features of the transfer functions better. FIG. 4 shows a plurality of biquad filters, including shelving filters 401*a* and 401*b* and peaking filters 403*a*, 403*b* and 403*c*, which can be implemented in the filter 105 of the audio signal processing apparatus 100 shown in FIG. 1 for minimizing the distance between the transfer functions obtained from the spectral analysis and the filter magnitude response, as already described above.

Figure 5:
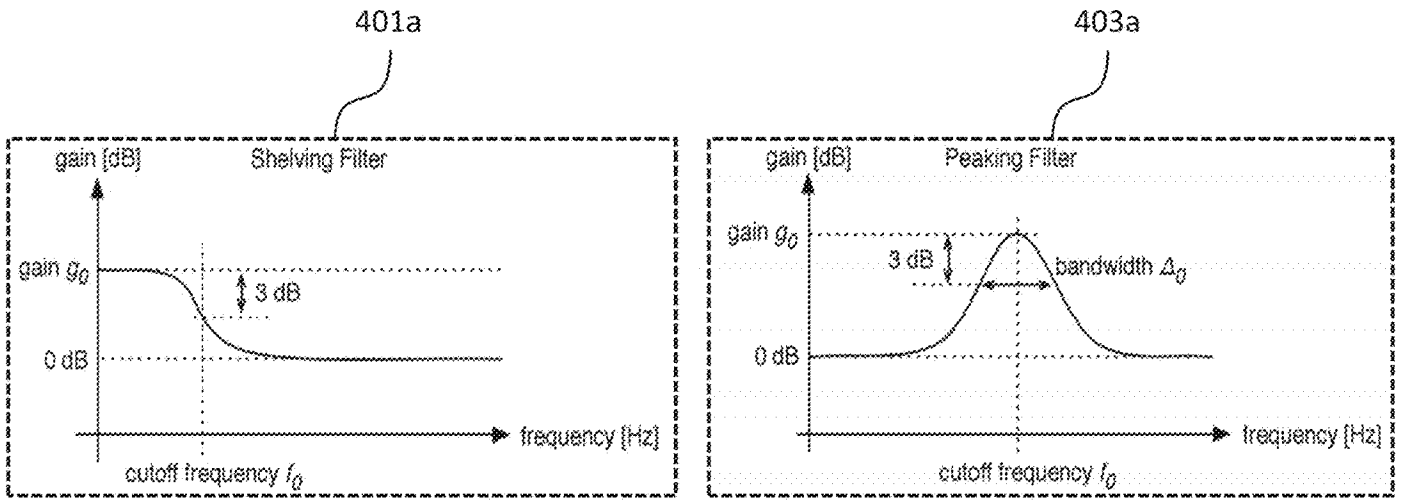
FIG. 5 shows schematic diagrams illustrating the frequency dependence of an exemplary shelving filter and the frequency dependence of an exemplary peaking filter, which can be implemented in an adjustment filter of an audio signal processing apparatus according to an embodiment.

FIG. 5 shows schematic diagrams illustrating the frequency dependence of an exemplary shelving filter 401*a* and the frequency dependence of an exemplary peaking filter 403*a*, which can be implemented in the filter 105 of the audio signal processing apparatus 100 shown in FIG. 1. The shelving filter 401*a* can be defined by two filter parameters, namely the cut-off frequency $f_0$ defining the frequency range, where the signal is changed, and the gain $g_0$ defining how much the signal is boosted (or attenuated if $g_0<0$ decibel (dB)). The peaking filter 403*a* can be defined by three filter parameters, namely the cut-off frequency $f_0$, where the peak is located, the gain $g_0$ defining the height of the peak (or of the notch if $g_0<0$ dB) and the bandwidth $\Delta_0$ of the peak (or notch), directly related to the quality factor $Q_0=f_0/\Delta_0$.

In an embodiment, the filter parameters can be obtained using numerical optimization methods.

However, in an embodiment, which is more memory efficient, an ad-hoc method can be used to derive the filter parameters on the basis of the spectral information provided, for instance, in FIG. 3. Thus, in an embodiment, for at least one infinite impulse response filter of the plurality of infinite response filters the plurality of predefined filter parameters are computed or selected by determining a frequency and an azimuth angle and/or an elevation angle, at which a left ear transfer function or a right ear transfer function of the plurality of pairs of measured left ear and right ear transfer functions has a minimal or maximal magnitude, and by approximating the frequency dependence of the left ear transfer function or the right ear transfer function of the plurality of pairs of measured left ear and right ear transfer functions by the frequency dependence of the at least one infinite impulse response filter.

Figure 6:
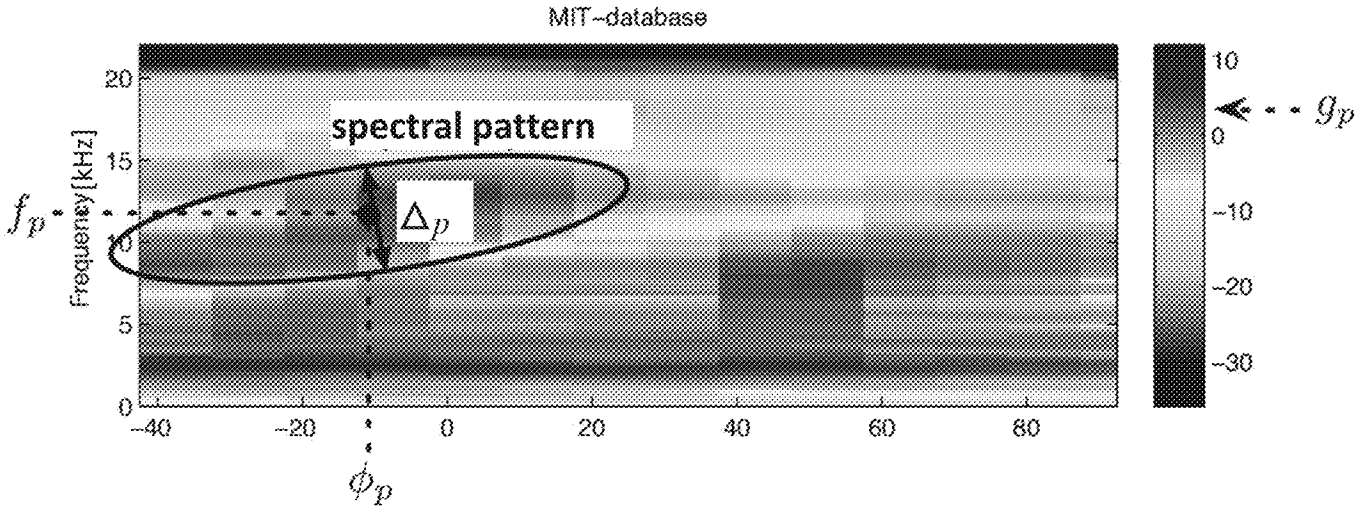
FIG. 6 shows a schematic diagram illustrating the selection of filter parameters by an audio signal processing apparatus according to an embodiment.

FIG. 6 shows a schematic diagram illustrating the selection of filter parameters using the data already shown in FIG. 3, which can be implemented in an audio signal processing apparatus according to an embodiment, for instance, the audio signal processing apparatus 100 shown in FIG. 1. The derivation of the filter parameters starts with locating the most significant spectral features, namely peaks and notches, in the measured transfer functions. For each of the identified features the relevant feature characteristics are then extracted, namely the corresponding central elevation angle $\phi_p$, which can be read on the horizontal axis, the corresponding central frequency $f_p$, which can be read on the vertical axis, the maximal corresponding spectral value $g_p$ (with $g_p>0$ corresponding to a peak and $g_p<0$ to a notch) and the maximal bandwidth $\Delta_p$.

In an embodiment, the filter parameters, namely the cut-off frequency parameter $f_0$, the gain parameter $g_0$ and the bandwidth parameter $\Delta_0$ (defined for the peaking filters 403*a-c*) are determined on the basis of the following equations:

$$f_0=\max(m_f,\min(M_f,a_f(\phi-\phi_p)^2+f_p)),$$

$$g_0=\max(m_g,\min(M_g,a_g(\phi-\phi_p)^2+g_p)),$$

$$\Delta_0=\max(m_\Delta,\min(M_\Delta,a_\Delta(\phi-\phi_p)^2+\Delta_p)).$$

wherein $M_{f,g,\Delta}$ and $m_{f,g,\Delta}$ denote maximal and minimal values of f,g,Δ, respectively, and wherein $a_{f,g,\Delta}$ denote coefficients controlling the speed of changing the corresponding filter design parameters.

In an embodiment, the parameters $M_{f,g,\Delta}$, $m_{f,g,\Delta}$ and $a_{f,g,\Delta}$ are set manually for the three filter design parameters $f_0$, $g_0$ and $\Delta_0$ to model the selected spectral feature as closely as possible.

Subsequently, the parameters M, m and a can be refined for all spectral features in such a way that the magnitude response of the infinite impulse response filters match the transfer functions obtained by the spectral analysis.

In the above described embodiment for determining the filter parameters only thirteen parameters ($\phi_p$, $f_p$, $g_p$, $\Delta_p$, $M_{f,g,\Delta}$, $r_{f,g,\Delta}$, $a_{f,g,\Delta}$) have to be stored for each infinite impulse response filter, wherein the first four parameters ($\phi_p$, $f_p$, $g_p$, $\Delta_p$) can be directly taken from the spectral analysis and the other parameters can be set manually.

Thus, given the equations described above the parameters of the filters 401*a,b* and 403*a-c* can be directly derived as a function of the desired elevation angle $\phi$. Given a predefined set of transfer functions measured only in the median plane, i.e. containing information only for certain radial distances r and certain elevation angles $\phi$. i.e. $h_L(r, 0, \phi)$ and $h_R(r, 0, \phi)$, these transfer functions can be extended to any desired azimuth angle $\theta$, i.e. to the third dimension, in a similar way as described above.

Figure 7:
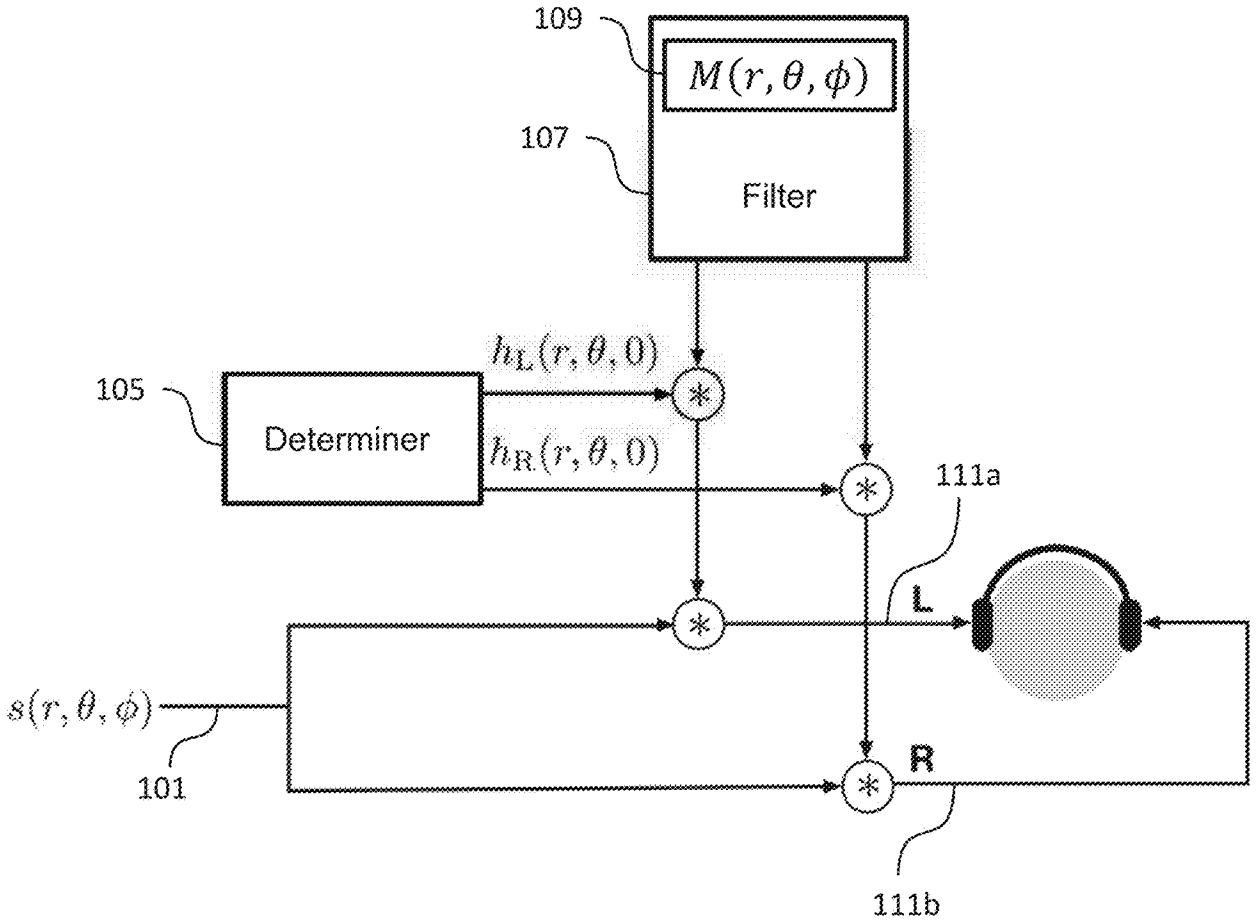
FIG. 7 shows a schematic diagram illustrating a part of an audio signal processing apparatus according to an embodiment.

FIG. 7 shows a part of an audio signal processing apparatus according to an embodiment, for instance part of the audio signal processing apparatus 100 shown in FIG. 1. In an embodiment, the adjustment filter 107 of the audio signal processing apparatus 100 is configured to filter the input audio signal 101 on the basis of the determined pair of left ear and right ear transfer functions and the adjustment function 109 by convolving the adjustment function 109 with the left ear transfer function and by convolving the result with the input audio signal 101 in order to obtain the left ear output 111*a* audio signal and/or by convolving the adjustment function 109 with the right car transfer function and by convolving the result with the input audio 101 signal in order to obtain the right ear output audio signal 111*b*.

Figure 8:
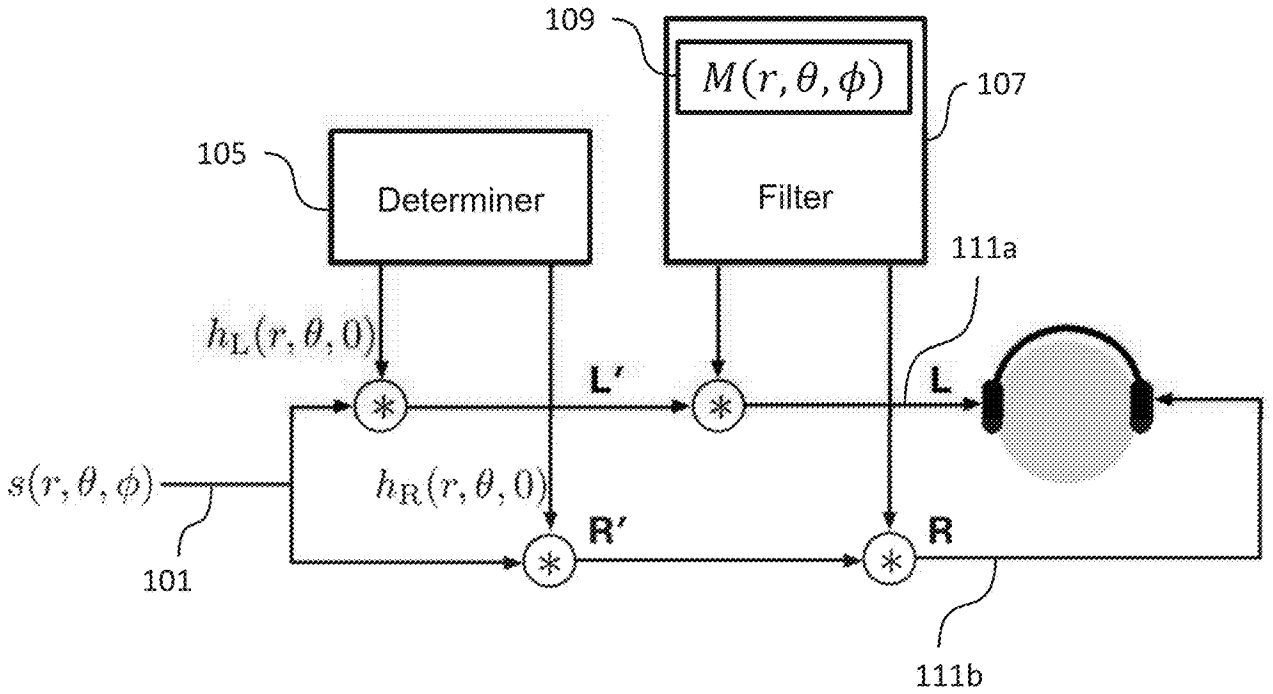
FIG. 8 shows a schematic diagram illustrating a part of an audio signal processing apparatus according to an embodiment.

FIG. 8 shows a part of an audio signal processing apparatus according to an embodiment, for instance part of the audio signal processing apparatus 100 shown in FIG. 1. In an embodiment, the adjustment filter 107 of the audio signal processing apparatus 100 is configured to filter the input audio signal 101 on the basis of the determined pair of left ear and right ear transfer functions and the adjustment function 109 by convolving the left ear transfer function with the input audio signal 101 and by convolving the result with the adjustment function 109 in order to obtain the left ear output audio signal 111*a* and/or by convolving the right ear transfer function with the input audio signal 101 and by convolving the result with the adjustment function 109 in order to obtain the right ear output audio signal 111*b*.

Figure 9:
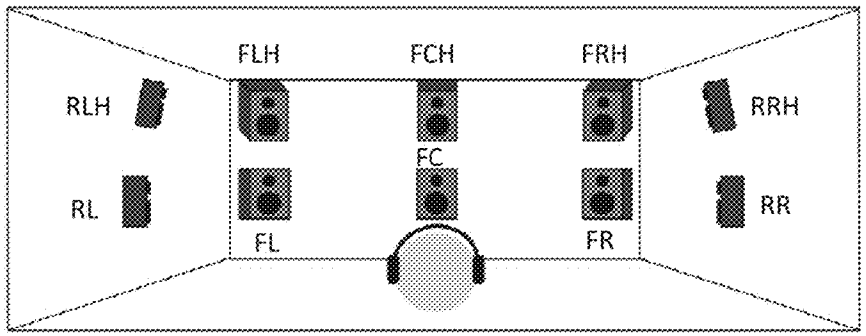
FIG. 9 shows a schematic diagram illustrating an exemplary scenario, where an audio signal processing apparatus according to an embodiment can be used, namely for binaural sound synthesis over headphones simulating a virtual loudspeaker surround system.

FIG. 9 shows a schematic diagram illustrating an exemplary scenario, where an audio signal processing apparatus according to an embodiment can be used, for instance, the audio signal processing apparatus 100 shown in FIG. 1. In the embodiment shown in FIG. 9, the audio signal processing apparatus 100 is configured to synthesize a binaural sound over headphones simulating a virtual loudspeaker surround system. To this end, the audio signal processing apparatus 100 can comprise at least one transducer, in particular headphones or loudspeakers using crosstalk cancellation configured to output the binaural sound, i.e. the left ear output audio signal 111*a* and the right ear output audio signal 111*b*.

In the example shown in FIG. 9 the virtual loudspeaker surround system, that is being simulated, is a 5.1 sound system setup with front left (FL), front right (FR), front center (FC), rear left (RL), and rear right (RR) loudspeakers. In this example, the five HRTFs corresponding to the five loudspeakers can be stored to synthesize the binaural sound for the virtual loudspeakers. Given the positions of desired height loudspeaker positions, front left height (FLH), front right height (FRH), front center height (FCH), rear left height (RLH), and rear right height (RRH), the audio signal processing apparatus 100 can efficiently extend the stored five horizontal HRTFs to the corresponding elevated ones. Thus, using the audio signal processing apparatus 100 the binaural rendering system over a 5.1 sound system is extended to a 10.2 sound system.

Figure 10:
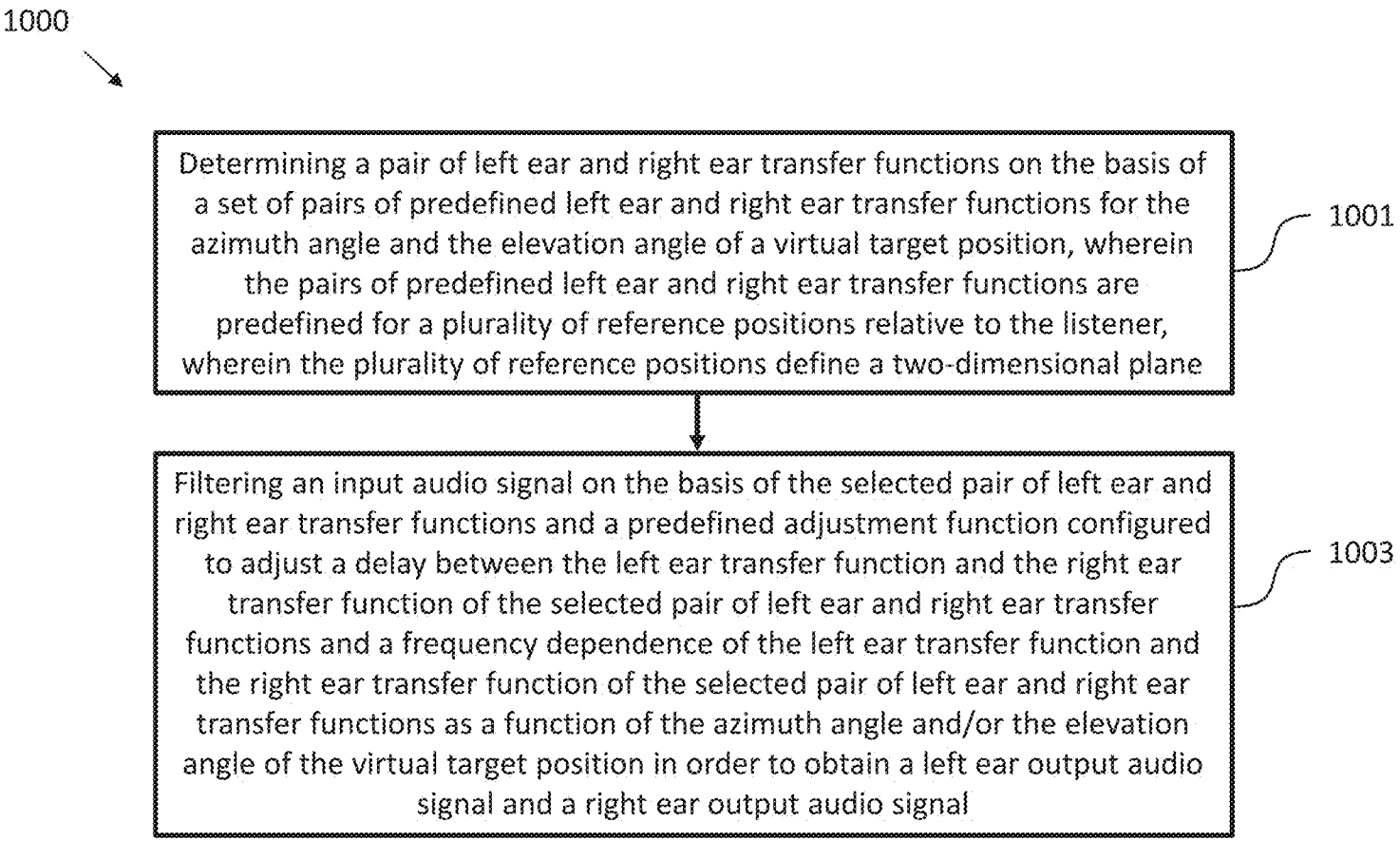
FIG. 10 shows a schematic diagram illustrating an audio signal processing method for processing an input audio signal according to an embodiment.

FIG. 10 shows a schematic diagram illustrating an audio signal processing method 1000 for processing an input audio signal 101 to be transmitted to a listener in such a way that the listener perceives the input audio signal 101 to come from a virtual target position defined by an azimuth angle and an elevation angle relative to the listener.

The audio signal processing method 1000 comprises the following steps of 1001 and 1003. The step 1001 includes determining a pair of left ear and right ear transfer functions on the basis of a set of pairs of predefined left ear and right ear transfer functions for the azimuth angle and the elevation angle of the virtual target position, wherein the pairs of predefined left eat and right ear transfer functions are predefined for a plurality of reference positions relative to the listener, wherein the plurality of reference positions lie in a two-dimensional plane, and the step 1003 includes filtering the input audio signal on the basis of the determined pair of left ear and right ear transfer functions and an adjustment function configured to adjust a delay between the left ear transfer function and the right ear transfer function of the determined pair of left ear and right ear transfer functions and a frequency dependence of the left ear transfer function and the right ear transfer function of the determined pair of left ear and right ear transfer functions as a function of the azimuth angle and/or the elevation angle of the virtual target position in order to obtain a left ear output audio signal and a right ear output audio signal.

Embodiments of the disclosure realize different advantages. The audio signal processing apparatus 100 and the audio signal processing method 1000 provide means to synthesize binaural sound, i.e. audio signals perceived by a listener as coming from a virtual target position. The audio signal processing apparatus 100 functions based on a "two-dimensional" predefined set of transfer functions, which can be either obtained from a generalized database or measured for a specific user. The audio signal processing apparatus 100 can also provide means for reinforcing front-back or elevation effect in synthesized sound. Embodiments of the disclosure can be applied in different scenarios, for example, in media playback, which is virtual surround rendering of more than 5.1 (e.g., 10.2, or even 22.2) by storing only 5.1 transfer functions and parameters to obtain all three-dimensional azimuth and elevation angles based on the basic two-dimensional set. Embodiments of the disclosure can also be applied in virtual reality in order obtain full sphere transfer functions with high resolution based on transfer functions with low resolution. Embodiments of the disclosure provide an effective realization of binaural sound synthesis with regard to the memory required and the complexity of the signal processing algorithms.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the disclosure beyond those described herein. While the present disclosure has been described with reference to one or more particular embodiments, those skilled in the art recognize that many changes may be made thereto without departing from the scope of the present disclosure. It is therefore to be understood that within the scope of the appended claims and their equivalents, the disclosure may be practiced otherwise than as described herein.

The invention claimed is:

1. An audio signal processing apparatus for processing an input audio signal, comprising:

a memory configured to store a set of pairs of predefined left ear and right ear transfer functions, wherein each pair of the set of pairs of the predefined left ear and right ear transfer functions is predefined for each reference position of a plurality of reference positions relative to a listener, wherein each of the reference positions lies in a two-dimensional plane;

a processor coupled to the memory and configured to determine a pair of left ear and right ear transfer functions of the set of pairs of the predefined left ear and right ear transfer functions according to an azimuth angle and an elevation angle of a virtual target position relative to the listener; and an adjustment filter coupled to the memory and the processor and configured to filter the input audio signal on a basis of the determined pair of the left ear and right ear transfer functions and an adjustment function, wherein the adjustment function is configured to:

adjust a delay between a determined left ear transfer function and a determined right ear transfer function of the determined pair of the left ear and right ear transfer functions; and adjust a frequency dependence of the determined left ear transfer function and the determined right ear transfer function as a function of the azimuth angle or the elevation angle on the basis of a plurality of infinite impulse response filters in order to obtain a left ear output audio signal and a right ear output audio signal, wherein a frequency dependence of each infinite impulse response filter of the plurality of infinite impulse response filters is defined by a plurality of predefined filter parameters, wherein for an infinite impulse response filter, the predefined filter parameters are selected by determining a frequency and the azimuth angle or the elevation angle at which a measured left ear transfer function or a measured right ear transfer function of pairs of measured left ear and right ear transfer functions has a minimal or a maximal magnitude; and a transmitter coupled to the memory and the processor and configured to transmit the left ear output audio signal and the right ear output audio signal to the listener to enable the listener to perceive the input audio signal as arriving from the virtual target position.

2. The audio signal processing apparatus of claim 1, wherein the adjustment filter is further configured to adjust the delay between the determined left ear transfer function and the determined right ear transfer function as a function of the azimuth angle and the elevation angle of the virtual target position by compensating for sound travel time differences associated with a first distance between the virtual target position and a left ear of the listener and a second distance between the virtual target position and a right ear of the listener.

3. The audio signal processing apparatus of claim 1, wherein the adjustment filter is further configured to adjust the delay between the determined left ear transfer function and the determined right ear transfer function as a function of the azimuth angle of the virtual target position by compensating for sound travel time differences associated with a first distance between the virtual target position and a left ear of the listener and a second distance between the virtual target position and a right ear of the listener.

4. The audio signal processing apparatus of claim 1, wherein the adjustment filter is further configured to adjust the delay between the determined left ear transfer function and the determined right ear transfer function as a function of the elevation angle of the virtual target position by compensating for sound travel time differences associated with a first distance between the virtual target position and a left ear of the listener and a second distance between the virtual target position and a right ear of the listener.

5. The audio signal processing apparatus of claim 1, wherein the adjustment filter is further configured to adjust the delay between the determined left ear transfer function and the determined right ear transfer function as a function of the azimuth angle or the elevation angle of the virtual target position on a basis of the following equations:

$$\tau_L(\Theta) = \tau\left(\Theta + \frac{\pi}{2}\right); \text{ and}$$

$$\tau_R(\Theta) = \tau\left(\Theta - \frac{\pi}{2}\right),$$

wherein the $\tau_L$ denotes a delay applied to the left ear transfer function, wherein the $\tau_R$ denotes a delay applied to the right ear transfer function, wherein the $\tau$ and the $\Theta$ is defined on a basis of the following equations:

$$\tau(\Theta) = \frac{a}{c}\sin\Theta; \text{ and}$$

$$\Theta = \begin{cases} \arcsin(\sin\theta\cos\phi), \text{ when } |\theta| < \frac{\pi}{2} \\ \frac{\theta}{|\theta|}\pi - \arcsin(\sin\theta\cos\phi), \text{ when } |\theta| \geq \frac{\pi}{2} \end{cases},$$

wherein the $\tau$ denotes the delay in seconds, wherein the c denotes a velocity of sound, wherein the a denotes a parameter associated with a head of the listener, wherein the $\theta$ denotes the azimuth angle of the virtual target position, and wherein the $\phi$ denotes the elevation angle of the virtual target position.

6. The audio signal processing apparatus of claim 1, wherein the adjustment filter is further configured to adjust the frequency dependence of the determined left ear transfer function and the determined right ear transfer function of the determined pair of the left ear and right ear transfer functions as the function of the azimuth angle or the elevation angle of the virtual target position on a basis of a plurality of infinite impulse response filters, and wherein the infinite impulse response filters are configured to approximate at least a portion of the frequency dependence of a left ear transfer function and a right ear transfer function of a plurality of the pairs of the measured left ear and right ear transfer functions as a function of the azimuth angle or the elevation angle of the virtual target position.

7. The audio signal processing apparatus of claim 6, wherein a frequency dependence of each infinite impulse response filter is defined by a plurality of predefined filter parameters, and wherein the predefined filter parameters are selected such that the frequency dependence of each infinite impulse response filter approximates at least a portion of the frequency dependence of the left ear transfer function or the right ear transfer function of the pairs of the measured left ear and right ear transfer functions as the function of the azimuth angle or the elevation angle of the virtual target position.

8. The audio signal processing apparatus of claim 7, wherein the plurality of infinite-impulse-response filters comprise a plurality of biquad filters, and wherein the biquad filters are implemented as parallel filters or cascaded filters.

9. The audio signal processing apparatus of claim 8, wherein the biquad filters comprise at least one shelving filter or at least one peaking filter, wherein the at least one shelving filter is defined by a cut-off frequency parameter ($f_0$) and a gain parameter ($g_0$), and wherein the at least one peaking filter is defined by the $f_0$, the $g_0$ and a bandwidth parameter ($\Delta_0$).

10. The audio signal processing apparatus of claim 1, wherein for the infinite impulse response filter, the predefined filter parameters are selected by approximating the frequency dependence of the measured left ear transfer function or the measured right ear transfer function by a frequency dependence of the infinite impulse response filter.

11. The audio signal processing apparatus of claim 9, wherein the $f_0$, the $g_0$, or the $\Delta_0$ are determined on a basis of the following equations:

$$f_0 = \max(m_f, \min(M_f, a_f(\phi - \phi_p)^2 + f_p)),$$

$$g_0 = \max(m_g, \min(M_g, a_g(\phi - \phi_p)^2 + g_p)),$$

$$\Delta_0 = \max(m_\Delta, \min(M_\Delta, a_\Delta(\phi - \phi_p)^2 + \Delta_p)),$$

wherein the $M_{f,g,\Delta}$ and the $m_{f,g,\Delta}$ denote maximal and minimal values of f, g, $\Delta$, respectively, and wherein the $a_{f,g,\Delta}$ denotes coefficients controlling a speed of changing corresponding filter parameters.

12. The audio signal processing apparatus of claim 1, wherein the adjustment filter is further configured to filter the input audio signal on the basis of the determined pair of the left ear and right ear transfer functions and the adjustment function by:

obtaining a first result by convolving the adjustment function with the left ear transfer function and by convolving the first result with the input audio signal in order to obtain the left ear output audio signal; or obtaining a second result by convolving the adjustment function with the right ear transfer function and by convolving the second result with the input audio signal in order to obtain the right ear output audio signal.

13. The audio signal processing apparatus of claim 1, wherein the adjustment filter is further configured to filter the input audio signal on the basis of the determined pair of left ear and right ear transfer functions and the adjustment function by:

obtaining a first result by convolving the left ear transfer function with the input audio signal and by convolving the first result with the adjustment function in order to obtain the left ear output audio signal; or obtaining a second result by convolving the right ear transfer function with the input audio signal and by convolving the second result with the adjustment function in order to obtain the right ear output audio signal.

14. The audio signal processing apparatus of claim 1, further comprising a pair of transducers configured to output the left ear output audio signal and the right ear output audio signal, and wherein the pair of transducers comprise headphones or loudspeakers using crosstalk cancellation.

15. The audio signal processing apparatus of claim 1, wherein the pairs of the predefined left ear and right ear transfer functions predefined for the reference positions relative to the listener lying in a horizontal plane relative to the listener.

16. The audio signal processing apparatus of claim 1, wherein when determining the pair of left ear and right ear transfer functions, the processor is further configured to:

select the pair of the left ear and right ear transfer functions from the set of pairs of the predefined left ear and right ear transfer functions for the azimuth angle and the elevation angle of the virtual target position; and interpolate the pair of the left ear and right ear transfer functions on the basis of the set of pairs of the predefined left ear and right ear transfer functions for the azimuth angle and the elevation angle of the virtual target position.

17. The audio signal processing apparatus of claim 1, wherein when determining the pair of left ear and right ear transfer functions, the processor is further configured to select the pair of the left ear and right ear transfer functions from the set of pairs of the predefined left ear and right ear transfer functions for the azimuth angle and the elevation angle of the virtual target position.

18. The audio signal processing apparatus of claim 1, wherein when determining the pair of left ear and right ear transfer functions, the processor is further configured to interpolate the pair of the left ear and right ear transfer functions on the basis of the set of pairs of the predefined left ear and right ear transfer functions for the azimuth angle and the elevation angle of the virtual target position.

19. An audio signal processing method for processing an input audio signal, comprising:

determining a pair of left ear and right ear transfer functions on a basis of a set of pairs of predefined left ear and right ear transfer functions according to an azimuth angle and an elevation angle of a virtual target position relative to a listener, wherein each pair of the set of pairs of the predefined left ear and right ear transfer functions is predefined for each reference position of a plurality of reference positions relative to the listener, and wherein each of the reference positions lies in a two-dimensional plane;

filtering the input audio signal on a basis of the determined pair of the left ear and right ear transfer functions and an adjustment function, wherein the adjustment function is configured to:

adjust a delay between a determined left ear transfer function and a determined right ear transfer function of the determined pair of the left ear and right ear transfer functions; and adjust a frequency dependence of the determined left ear transfer function and the determined right ear transfer function as a function of the azimuth angle or the elevation angle on the basis of a plurality of infinite impulse response filters in order to obtain a left ear output audio signal and a right ear output audio signal, wherein a frequency dependence of each infinite impulse response filter of the plurality of infinite impulse response filters is defined by a plurality of predefined filter parameters, wherein for an infinite impulse response filter, the predefined filter parameters are selected by determining a frequency and the azimuth angle or the elevation angle at which a measured left ear transfer function or a measured right ear transfer function of pairs of measured left ear and right ear transfer functions has a minimal or a maximal magnitude; and transmitting the left ear output audio signal and the right ear output audio signal to the listener to enable the listener to perceive the input audio signal as arriving from the virtual target position.

20. A computer program product comprising a non-transitory computer readable storage medium storing program code thereon for processing an input audio signal, wherein the program code comprises instructions for executing a method that comprises:

determining a pair of left ear and right ear transfer functions on a basis of a set of pairs of predefined left ear and right ear transfer functions according to an azimuth angle and an elevation angle of a virtual target position relative to a listener, wherein each pair of the set of pairs of the predefined left ear and right ear transfer functions is predefined for each reference position of a plurality of reference positions relative to the listener, and wherein each of the reference positions lies in a two-dimensional plane;

filtering the input audio signal on a basis of the determined pair of the left ear and right ear transfer functions and an adjustment function, wherein the adjustment function is configured to:

adjust a delay between a determined left ear transfer function and a determined right ear transfer function of the determined pair of the left ear and right ear transfer functions; and adjust a frequency dependence of the determined left ear transfer function and the determined right ear transfer function as a function of at least one of the azimuth angle or the elevation angle on the basis of a plurality of infinite impulse response filters in order to obtain a left ear output audio signal and a right ear output audio signal, wherein a frequency dependence of each infinite impulse response filter of the plurality of infinite impulse response filters is defined by a plurality of predefined filter parameters, wherein for an infinite impulse response filter, the predefined filter parameters are selected by determining a frequency and the azimuth angle or the elevation angle at which a measured left ear transfer function or a measured right ear transfer function of pairs of measured left ear and right ear transfer functions has a minimal or a maximal magnitude; and transmitting the left ear output audio signal and the right ear output audio signal to the listener to enable the listener to perceive the input audio signal as arriving from the virtual target position.

* * * * *